United States Patent [19]

Partensky

[11] 3,944,451

[45] Mar. 16, 1976

[54] METHOD OF AND APPARATUS FOR MAKING A PLUSH-TYPE CLOTH

[75] Inventor: Pierre Jean Marc Partensky, Lyon, France

[73] Assignee: Societe Anonyme dite B.T.B. Benoit le Tapis Brosse, Lyon, France

[22] Filed: July 8, 1974

[21] Appl. No.: 486,512

[30] Foreign Application Priority Data

July 10, 1973 France ..... 73.26386

[52] U.S. Cl. ..... 156/72; 156/435

[51] Int. Cl.[2] ..... D04H 11/00

[58] Field of Search ..... 156/72, 435, 265, 267

[56] References Cited

UNITED STATES PATENTS

| | | | |
|---|---|---|---|
| 2,792,051 | 5/1957 | Jacquet | 156/72 |
| 3,477,889 | 11/1969 | Partensky | 156/72 |
| 3,479,241 | 11/1969 | Partensky | 156/72 |
| 3,580,761 | 5/1971 | Boultinghouse | 156/72 |
| 3,839,114 | 10/1974 | Schmidt et al. | 156/72 |

*Primary Examiner*—Douglas J. Drummond
*Assistant Examiner*—Michael W. Ball
*Attorney, Agent, or Firm*—Karl F. Ross; Herbert Dubno

[57] ABSTRACT

A web formed of a multiplicity of general parallel fibers or filaments is fed downwardly and incrementally toward a platen forming a lower element of a generally horizontal guide. A shear periodically moves across the path of the web so as to shear from the end thereof a section having a length slightly greater than the height of the guide. The lower edge of the upper element of the guide constitutes one of the shear elements so that as each section is cut off it is pressed into the end of the guide. Simultaneously with each cutting operation the stack formed in the guide is moved incrementally toward the downstream end thereof. As the stack emerges from the downstream end the sections are pressed end-wise into an adhesive layer on a substrate.

2 Claims, 3 Drawing Figures

FIG. 1
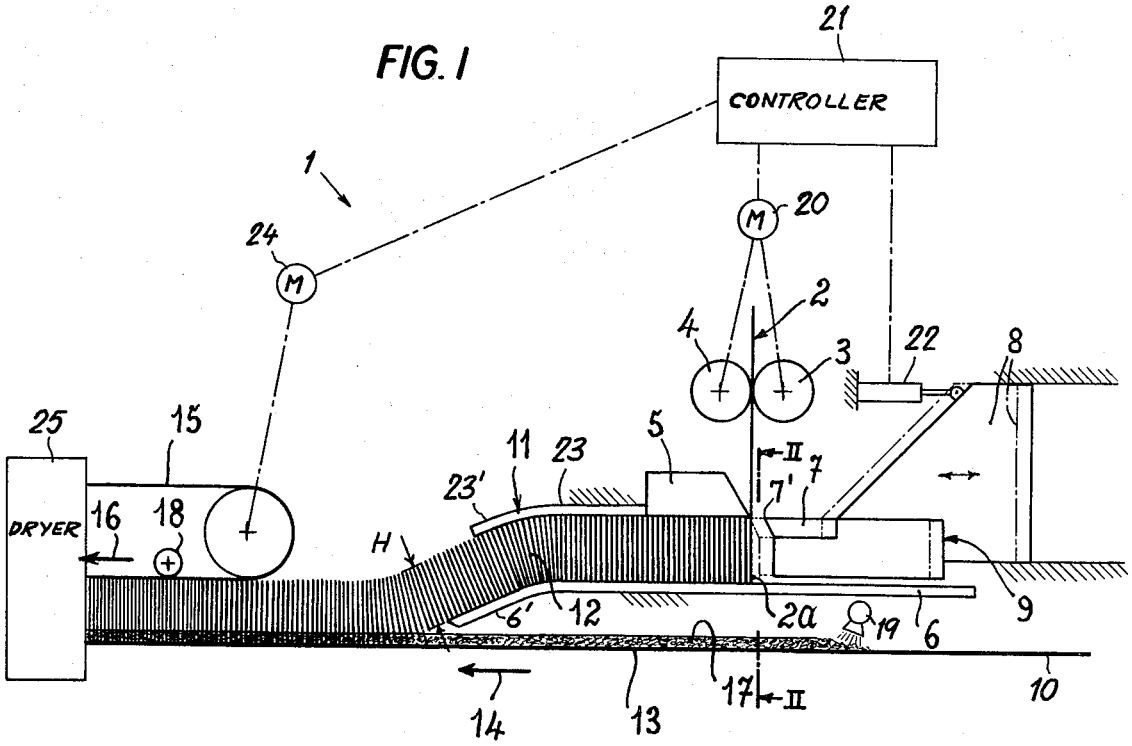
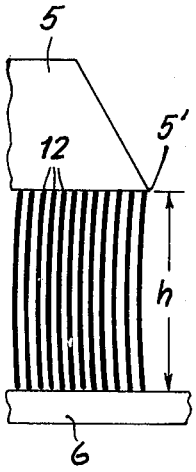
FIG. 3
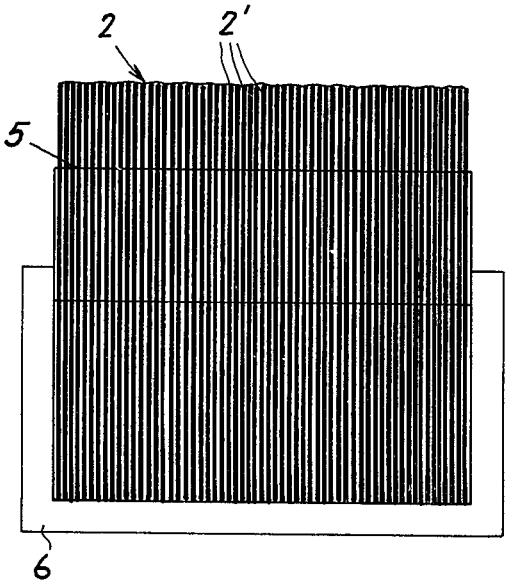
FIG. 2

METHOD OF AND APPARATUS FOR MAKING A PLUSH-TYPE CLOTH

FIELD OF THE INVENTION

The present invention relates to a method of and an apparatus for making a plush-type cloth. More particularly this invention concerns the production of a plush-type cloth in which the pile is implanted in a nonwoven synthetic-resin base.

BACKGROUND OF THE INVENTION

It is known to produce plush-type cloth by weaving an additional work yarn or filling yarn into a textile base and drawing this additional yarn away from the surface of the fabric. This forms loops which may thereafter be cut so as to produce so-called warp pile fabric. Although such fabric is strong and durable, its production is expensive.

It is also known to implant fibers or short thread sections in a synthetic-resin base. Usually a rubber-type base is employed, the product being used as a bath mat, rug, or the like. Various methods have been proposed to form such a nonwoven plush-type cloth, but none of them combines simplicity with sureness in operation.

OBJECTS OF THE INVENTION

It is therefore an object of the present invention to provide an improved method of and apparatus for making a plush-type cloth.

Another object of this invention is the provision of a system for making nonwoven plush fabric.

SUMMARY OF THE INVENTION

These objects are attained according to the present invention in a system wherein a web is displaced downwardly toward a platen of a cutting station until the end of the web bends slightly. Then this end section is cut from the web and is pressed into the upstream end of an elongated generally horizontal guide having a height slightly shorter than the rectified length of the section and with the sections oriented ordinarily transversely to the guide so that their ends rub the upper and lower walls of the guide. Each time a section is pressed into the upstream end of the guide the stack formed in the guide is moved an increment toward the downstream end of the guide. As the sections emerge from the downstream end they are pressed end-wise against an adhesive surface of a flat substrate. The adhesive surface of the substrate is then hardened so as to bond the sections permanently thereto.

The method according to the present invention operates with great simplicity. When a web is used comprising a mass of generally parallel filaments it is possible rapidly and surely to produce a plush-type cloth which has the appearance and characteristic of woven plush, while being considerably less expensive to produce.

In accordance with another feature of this invention the apparatus for feeding the web to the cutting stations comprises a pair of juxtaposed rollers between whose nips the web is incrementally downwardly displaced, effectively hanging with its lower end in the cutting station. The lower edge of the element constituting the upper wall of the guide serves as half of the shear that cuts the end off the web so that the operations of cutting-off the end section and pressing it into the upstream end of the guide are carried out simultaneously.

In accordance with yet another feature of this invention the means for pressing the sections end-wise into the adhesive-coated surface of the substrate comprises an endless band whose lower stretch is parallel to the substrate immediately downstream from the downstream end of the guide.

BRIEF DESCRIPTION OF THE DRAWING

These and other objects, features, and advantages will become more readily apparent from the following description, reference being made to the accompanying drawing in which:

FIG. 1 is a side view partly in diagrammatic form illustrating the method and apparatus according to the present invention;

FIG. 2 is a view taken in the direction of arrows II of FIG. 1; and

FIG. 3 is a large-scale view of a detail of FIG. 1.

SPECIFIC DESCRIPTION

As shown in FIGS. 1 and 2 an apparatus 1 for carrying out the method according to the present invention has a base surface 10 along which is continuously displaced a substrate 13 in a downstream direction 14. A nozzle 19 serves to form on the upper surface of this substrate 13 a thick layer 17 of a thermosetting adhesive.

A web 2 formed as shown in FIG. 2 of a multiplicity of generally parallel fibers or filaments 2′ is displaced downwardly between a pair of rollers 3 and 4 operated by a motor 20 itself connected to a control device 21. The motor 20 is operated to advance the web 2 in increments of 2 cm toward a platen 6 forming the lower element of an elongated guide 11. After the lower end 2*a* strikes the platen 6 and the web 2 bends at this lower end 2*a* pusher element 9 having an upper shear blade 7 and mounted on horizontally reciprocal support 8 is displaced across the path of the web 2 by a cylinder 22 also operated by the control 21. This cylinder 22 is actuated once each time the web 2 is advanced so as to cut sections 12 having a height H = 2 cm off the end of the web 2.

Blade 7 has an edge 7′ which cooperates with the edge 5′ of a blade 5 constituting part of the upper element of the guide 11. Another element 23 downstream and in line with the lower edge of the blade 5 extends parallel to the platen 6 and has a downstream end 23′ which, like the downstream end 6′ of the platen 6, is inclined downwardly toward the support surface 10.

The spacing between the upper elements 5, 23, 23′ and the lower elements 6, 6′ of the guide 11 is continuous and is equal to *h* which is slightly shorter, here by 0.5 mm, than the height H. This causes the section 12 to be bowed slightly in the guide 11 as is shown in FIG. 3. The inner sides of the guide 11 are perfectly smooth so that the stack formed therein will move regularly and incrementally each time a new section 12 is cut from the web 2 and this section is pressed into the upstream end of the guide by the pusher 9.

As the stack of section 12 issues from the downstream end of the guide 11 the lower ends of the individual vertical fibers constituting the sections 12 engage the adhesive layer 17 on the substrate 13. Further downstream a pressure belt 15 spanned over rollers 18 and whose lower stretch is displaced downstream in direction 16 by a motor 24 at a rate of advance identical to the rate of advance of the substrate 13 in direction 14, these fibers are pressed downwardly end-wise into the layer 17. The spacing between the lower surface of the lower reach of the belt 15 and the upper surface of the substrate 13 is equal to *h* so that the fibers are pressed firmly and deeply into this layer 17.

Thereafter the thus formed cloth enters a dryer 25 where it is heated and the adhesive layer 17 is set.

The fibers in accordance with this invention are a polyamide such as Nylon as is the base. The adhesive layer 17 is a polyacrylate thermosetting adhesive.

The controller 21 operates the motor 24 and can operate motor at a faster rate so as to give the pile on the substrate 13 a nap.

I claim:

1. An apparatus for making a nonwoven plush-type cloth, said apparatus comprising:

a generally horizontal guide having a horizontal upper guide element and a lower guide element spaced vertically apart by a predetermined distance, said guide having an upstream end and a downstream end, feed means for advancing a web downwardly toward said upstream end, cutting means at said upstream end for severing from said web sections having a length slightly greater than said distance and for pushing the cut sections into said upstream end of said guide to form therein a stack, whereby said stack is displaced horizontally toward said downstream end by an increment each time a new cut section is pushed into said upstream end; and compression means at said downstream end for pressing said sections as they emerge therefrom endwise down into an adhesive coated substrate, said cutting means including a blade horizontally displaceable across said upper guide element and forming therewith a shear, said feed means advancing said web downwardly in increments equal to said length said guide being spaced above and parallel to said substrate at said upstream end and said downstream end being turned downwardly toward said substrate, means for coating said substrate with an adhesive and means for advancing said substrate so coated past said downstream end of said guide, said compression means at said downstream end including a horizontal support for said substrate and a band spaced above said support and driven at substantially the same speed as the advance speed of said substrate.

2. A method of making a plush-type cloth, said method comprising the steps of:

a. advancing a substrate along a horizontal path;

b. applying an adhesive layer to the upper surface of said substrate;

c. advancing a web of plush-forming material downwardly toward said layer in a vertical direction;

d. intercepting the leading lower edge of said web above said adhesive layer on a horizontal guide prior to engagement of said web with said surface;

e. severing a section from said web by displacing a blade horizontally above said guide and against an upper horizontal guide forming a counterblade, said guides defining a horizontal channel spaced above but parallel to said substrate;

f. pressing the cut section into said channel, thereby forming a succession of cut sections in the form of a horizontal stack within said channel;

g. deflecting said stack downwardly toward said adhesive layer with said sections substantially perpendicular to said substrate;

h. pressing said sections applied to said adhesive layer into the latter to implant the respective lower edges of said sections therein by passing said sections between a belt spaced above and parallel to said substrate; and i. setting said adhesive layer.

* * * * *